US005322286A

United States Patent [19]

Frost

[11] Patent Number: 5,322,286

[45] Date of Patent: * Jun. 21, 1994

[54] HAND ACCESSORY FOR SWINGING AN IMPLEMENT HANDLE

[76] Inventor: John H. Frost, 781 S. Kohler St., Los Angeles, Calif. 90021

[ * ] Notice: The portion of the term of this patent subsequent to Dec. 3, 2008 has been disclaimed.

[21] Appl. No.: 937,108

[22] Filed: Aug. 31, 1992

[51] Int. Cl.[5] ..... A63B 57/00

[52] U.S. Cl. ..... 273/165; 2/20

[58] Field of Search ..... 273/165, 166, 25, 26 R, 273/26 C, 81 D, 67 B, 75, 67 DB; 2/16–21; 74/551.9; 16/DIG. 18, DIG. 19, DIG. 12; D8 DIG. 6, DIG. 7, DIG. 8; 280/821, 822

[56] References Cited

U.S. PATENT DOCUMENTS

| | | | |
|---|---|---|---|
| 1,690,312 | 11/1928 | Rosan | 273/165 |
| 2,962,288 | 11/1960 | Lowden | 273/165 |
| 3,436,090 | 4/1969 | Lange et al. | 280/821 |
| 3,868,110 | 2/1975 | Jones | 273/75 |
| 3,879,048 | 4/1975 | Penney | 273/81 D X |
| 3,992,021 | 11/1976 | Tobin | 273/166 X |
| 4,613,156 | 9/1986 | Lajos | 280/821 |
| 4,641,857 | 2/1987 | Gailiunas | 280/821 |
| 4,750,760 | 6/1988 | Gurley | 280/821 |
| 5,180,165 | 1/1993 | Frost | 273/165 |

FOREIGN PATENT DOCUMENTS

| | | | |
|---|---|---|---|
| 688541 | 2/1940 | Fed. Rep. of Germany | 74/551.9 |
| 1112170 | 3/1956 | France | 74/551.9 |
| 2503571 | 10/1982 | France | 280/821 |

*Primary Examiner*—Vincent Millin
*Assistant Examiner*—Sebastiano Passaniti
*Attorney, Agent, or Firm*—Jack C. Munro

[57] ABSTRACT

A hand accessory contoured to fit primarily within the trailing hand of a pair of hands that are usable to swing a handle of an implement such as a baseball bat. Hand accessories extend between the web portion of the hand and the little finger of the hand. The hand accessory is contoured to be comfortable within the hand and to maximize speed and control of the swing to impart increased power with increased control of flight to a baseball which is struck with the baseball bat that is swung utilizing the hand accessory of this invention.

11 Claims, 3 Drawing Sheets

HAND ACCESSORY FOR SWINGING AN IMPLEMENT HANDLE

BACKGROUND OF THE INVENTION

1) FIELD OF THE INVENTION

The field of this invention generally relates to hand accessories useful for improving power transmission and improving control of swinging movement between the hands of a human and the handle of an implement such as a baseball bat, thereby transmitting a greater amount of power and control of flight to a baseball that is struck with the baseball bat.

2) DESCRIPTION OF THE PRIOR ART

The subject matter of the present invention is an improvement over the structure defined within U.S. Pat. No. 5,069,454, issued Dec. 3, 1991, and U.S. pending patent application 07/783,176 filed Oct. 28, 1991, both carrying the title Hand Accessory and both invented by the present inventor.

The concept of the present invention is going to be discussed in terms of swinging of a baseball bat. However, it is to be considered to be within the scope of this invention that this invention could be applied in conjunction with any implement for swinging that implement as required.

When swinging a baseball bat, there is a certain amount of pivoting of the bat relative to each hand of the user. The user places both hands on the baseball bat with the hand located nearest the butt of the baseball bat being defined as the leading hand, and the hand located above the leading hand (nearer the striking area of the bat) being defined as the trailing hand. The center of the pivoting action is near the middle of the palm of each hand. The portion of the bat extending from the middle of the palm upward toward the contact area of the bat will move away from the body of the user during the swinging motion with the portion of the bat extending from the middle of the palm downward toward the butt of the bat moving towards the body of the user. This movement occurs at the start of the swing just after the bat leaves the "cocked" position. As the hands attempt to propel the bat forward, not only does the palm and web area of the hand push outward, but the hands tighten their grip with the fingers pulling inward (towards the user) and downward (toward the ground). At this time, there is a strain on the ring and little fingers of the hands in attempting to bring about this rotation of the bat as the inertial force of the bat is moving against those fingers.

When gripping and swinging a baseball bat, there is a space between the handle and the base of the thumb and the forefinger which is filled with a loose compressible web of skin. This area of the hand is a low-density space which contains no bone or muscle. When the user's hand moves forward as the user swings the baseball bat prior to impact, the baseball bat handle inertially moves momentarily from the fingers back into this web of skin. At this time, the user loses power and control in the swinging movement. Just immediately prior to impact or even just after impact, the baseball bat will return into the fingers as it catches up to the forward motion of the hand. However, power and control have been lost. At the force of impact, if the ball does not strike the optimal point (or "meat") of the bat, the bat will again recoil slightly into the web compressing such, this compressing of the web absorbs and dissipates energy otherwise transmissible to the ball thus causing a weaker strike of the ball.

There is a need for a device to improve control and force transmission between the hand and the handle of the bat. The device should also reduce strain on the fingers. The present inventor has obtained a U.S. Pat. No. 5,069,454 and has a U.S. patent pending 07/783,176, previously mentioned, both of which are directed toward the elimination of the above-described weakness of the human hands when gripping to swing a thin-handled instrument such as a baseball bat. Success was achieved in the aforementioned patent and patent pending for the lead hand (left for right-hand hitter and right for left-hand hitter) in the swinging motion. However, the present inventor encountered difficulty in obtaining the maximum efficiency within the trailing hand (right hand for a right-hand hitter and left hand for a left-hand hitter).

The devices described in the aforementioned patent and patent pending did not achieve the amount of comfort, control or bat speed desired by the inventor. It should be noted that it has been found when a certain change results in an increase in bat speed it usually also increases comfort and control, and vice versa, so when describing a feature which, for example, improves comfort, it should be understood that reference is being made only to the most noticeable benefit and that the other benefits of speed and control are probably also improved by the same feature.

It was found that the elimination of the discomfort to the hand, including the fingers, could not be accomplished by merely rounding or reducing the amount of material in the affected areas of the hand accessory device. Every section of the hand accessory device had to be angled correctly in order to bring about perfect distribution of force throughout the strong and weak areas of the hands. If one section of the device was wrong, it might cause the correct sections of the device to also be wrong. Thus, the intent of the present application is to redefine the prior art devices shown and described within the aforementioned U.S. patent and U.S. patent pending to improve the performance of these prior art devices.

SUMMARY OF THE INVENTION

Through trial and error and use of a radar gun, optimal angles and shapes of the prior art devices as previously mentioned have been discovered to provide the greatest speed of the bat and most uniform distribution of force to the hands thereby providing maximum comfort and stability of the hand accessory device within the hand. The hand accessory of this invention comprises a contoured, shaped, primarily solid block which has a generally inverted L-shape, one portion of which is to fit into the palm and a horizontal top portion which is to impress into the web portion of the hand between the base of the thumb and the base of the forefinger. This horizontal top portion may include a back section extending from the horizontal top portion to press into the back side of the web but making no contact with any bones of the hand, in particular those bones leading to the thumb and forefinger. A vertical portion of the plug is integral with the horizontal top portion and descends therefrom down into the palm of the hand ending near the tough, muscular area just below the skin crease at the third joint (joint with the palm) of the little finger. The plug includes a lateral flange positioned against the ball of the thumb to further increase stability and power. The rear of the plug, which is in direct contact with the hand, rather than being rounded, has a precise definition which includes sharp angles which fit the hand and increase the stability when gripping and swinging so as to transfer power from the arms of the user to the bat through the strongest area of the hands. In comparing the structure of the present invention over the devices within the aforementioned patent and patent pending, the present invention lengthens the portion of the device which receives the handle of the bat in the area of the ring and little fingers to approximately half way between the second and third joints of the fingers to provide additional resistance against the inertial force of the bat thereby reducing the amount of strength required in the ring and little fingers and reducing the amount of force being dissipated, in other words, a quicker swing of the bat. The structure of the present invention is directed primarily towards the trailing hand. The optimum point for power transfer from the trailing hand through the device to the bat handle is below the web portion of the hand in the center or palm area of the hand. The right combination of angles and shapes has now been found within the present invention to achieve optimum power transfer. The preferred embodiment of this invention for the trailing hand is a plug filling the palm in the shape of a right triangle with the top area of the plug being thinned and contoured to press into the web for stability but angled such that the force of the handle by inertia is not received by the top of the hand. The main portion of the force is received by the more forceful applying mid-area of the hand and the extreme lower part of the ball of the thumb. It should be noted that because of the tapering extensions of the device to the web, thumb and the fingers, the right triangle configuration of the device is not readily apparent unless the above-mentioned extensions are removed. The hand accessory device of this invention includes a channel within which the bat is to be located with the longitudinal axis of this channel intersecting the third joint of the index finger. This positioning of the bat is for maximum power transfer in the swinging motion. The hand accessory device also includes a groove formed within the device located between the channel and the thumb. This groove gives a certain amount of flexibility to the hand accessory device permitting some deflection of the device when the user tightens his or her grip on the device in conjunction with the handle of the bat. Also the back surface of the device, which is in direct contact with the hand, although generally convex, contains a plurality of specifically arranged concave areas each of which is to connect with a specific area of the hand to maximize comfort so as to maximize power transfer in the swinging motion of the bat.

One of the objectives of the hand accessory of the present invention is that the hand accessory may be worn unnoticed under a batting glove (permanently attached or removable) which in turn could be worn under a fielding glove.

DETAILED DESCRIPTION OF THE SHOWN EMBODIMENT

Figure 1:
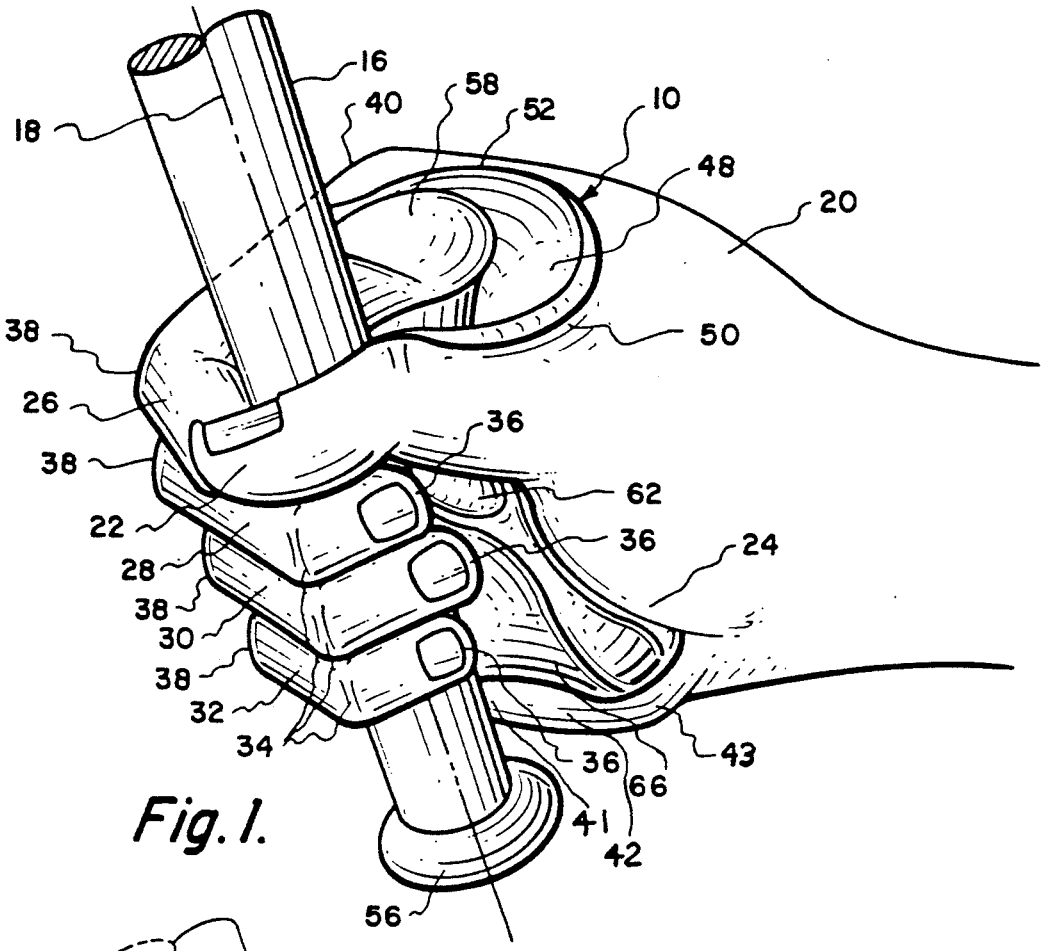
FIG. 1 is a front isometric view of the hand accessory of the present invention showing the hand accessory being mounted within a human hand which is gripping a handle of a baseball bat.
Figure 2:
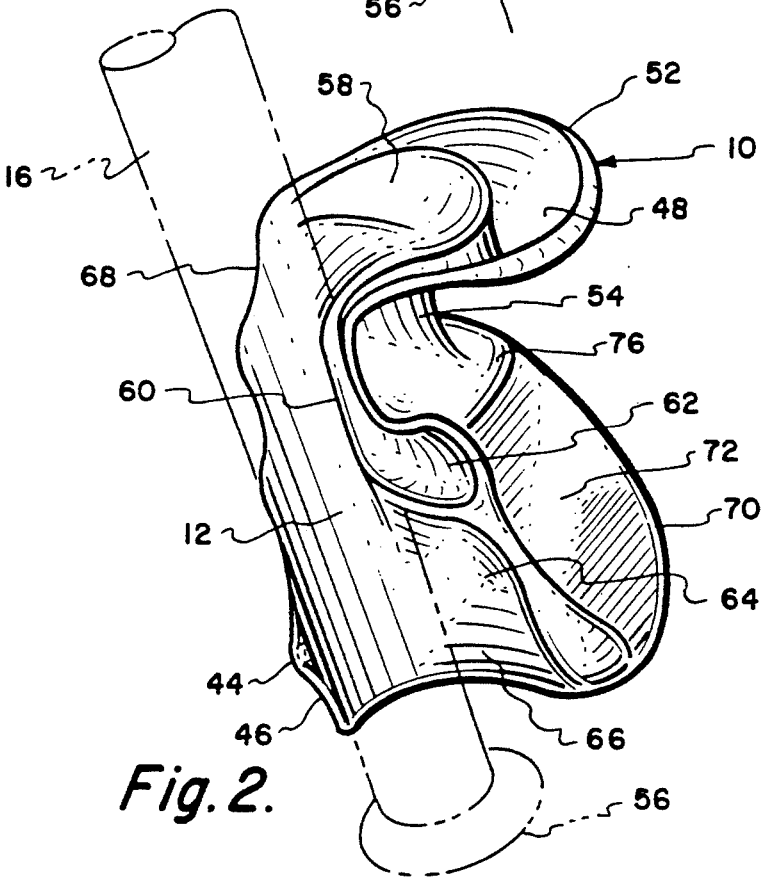
FIG. 2 is a front isometric view similar to FIG. 1 but showing the baseball bat in phantom and the hand removed.
Figure 3:
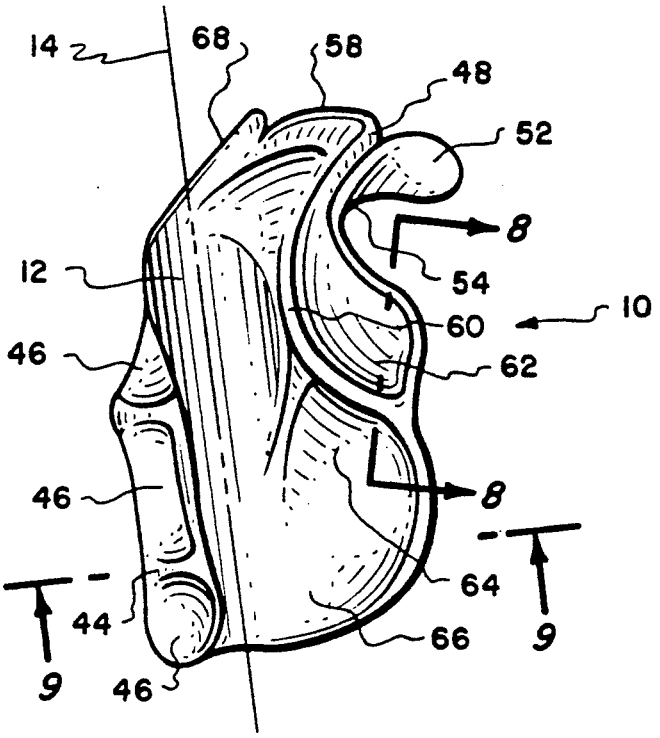
FIG. 3 is a front view of the hand accessory of this invention.
Figure 4:
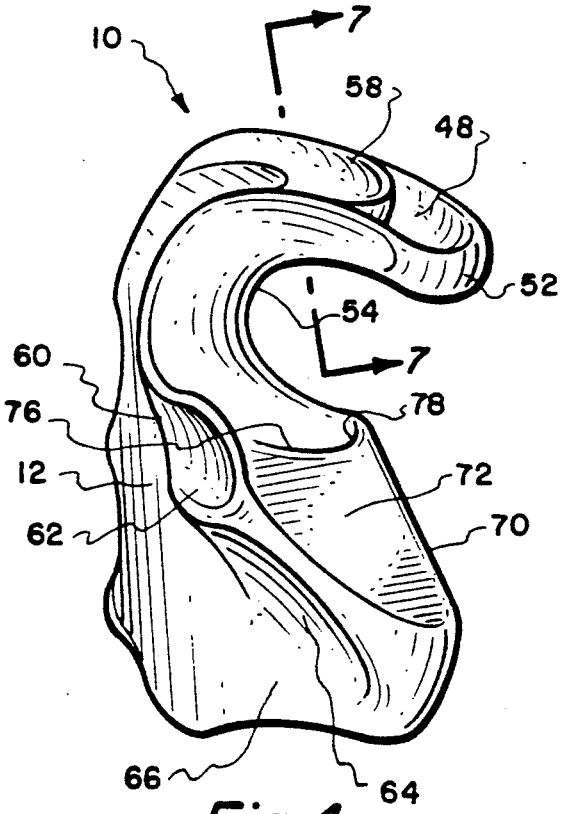
FIG. 4 is a right-side view of the hand accessory of this invention.
Figure 5:
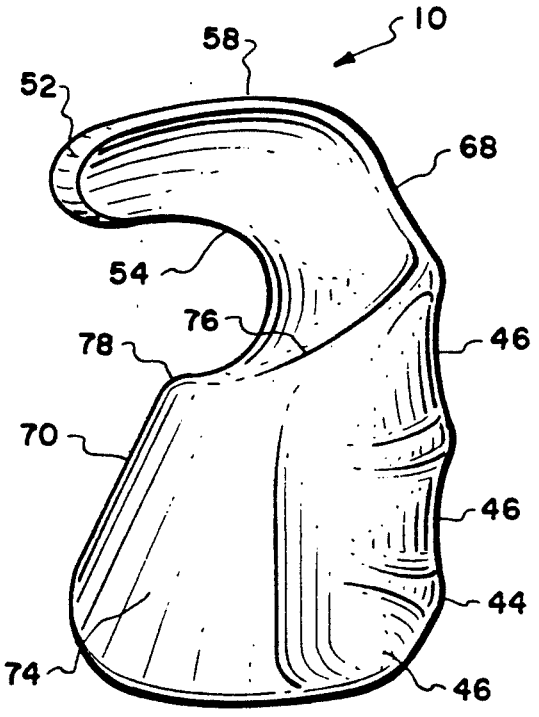
FIG. 5 is a left-side view of the hand accessory of this invention.
Figure 6:
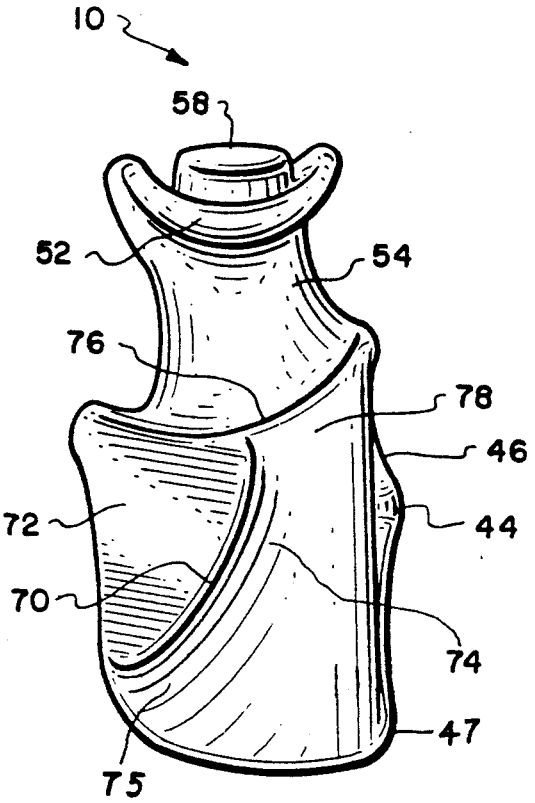
FIG. 6 is a back view of the hand accessory of this invention.

The use of a plug type of accessory to be placed within the hand when swinging of a baseball bat has been discussed within the aforementioned U.S. Pat. No. 5,069,454 and U.S. Patent Pending 07/783,176. U.S. Pat. No. 5,069,454 was directed principally to the leading hand and the use of a hand accessory in conjunction with the leading hand. It has been found that if a hand accessory is designed properly to be used in conjunction with the trailing hand, a further increase in power and control in swinging of the baseball bat can be achieved.

It has been found that a subtle, though important, difference in shape is required within the hand accessories for each hand in order to provide maximum performance. This is due to several factors such as (1) the difference in the angle of each hand gripping the bat, (2) the trailing hand having to reach farther than the leading hand at the point of impact, (3) the difference in shape of the bat handle along the length of the hand accessory and (4) the dynamics of the swing itself since the leading hand initiates the swing and is pulling while the trailing hand is pushing to catch up. All of the above causes the force to be received to a greater extent at the bottom area of the leading hand and to a greater extent at the top area of the trailing hand. The leading hand plug should preferably be manufactured of a softer material than the trailing hand plug since the leading hand has more time for energy return. Therefore, the trailing hand plug might be constructed of a plastic where the leading hand plug would be constructed of rubber impregnated plastic.

Referring particularly to the drawings, there is shown the hand accessory 10 of this invention which is basically in the form of a solid plug. This solid plug will normally be constructed of a plastic material. The hand accessory 10 has a front surface which includes an elongated open-ended channel 12 which has a longitudinal center axis 14. The handle 16 of the baseball bat is to be located within the channel 14. The baseball bat handle 16 has a longitudinal center axis 18. The axis 18 is to be parallel to the axis 14. For purposes of description, the hand accessory 10 is shown mounted within a right hand 20 of a human. This right hand 20 includes a thumb 22 which is connected to the hand 20 by means of a muscular thumb base 24. The hand 20 includes an index finger 26, a middle finger 28, a ring finger 30 and a little finger 32 which are wrapped around the handle 16. Each of the fingers 26, 28, 30 and 32 includes a first joint 34 which is located nearest the outer end or the finger nail section 36 of each of the fingers. Each of the fingers 26, 28, 30 and 32 also include a second joint 38 which is located in between the first joint 34 and the third joint 40 with only the third joint 40 being shown for the index finger 26. Each of the joints 34, 38 and 40 form creases on the inside surface of the hand 20 with these creases being within the skin of the hand 20. Third joint 40 forms such a crease although such can not be observed from the drawings. However, the location of the channel 12 is such that the axis 14 intersects that crease of the joint 40 of the index finger 26. It is also to be understood that when the hand 20 wraps around the handle 16 there is a somewhat vertical crease known as the life line crease within the hand 20 and there is also a horizontal or transverse crease across the hand at the upper edge of the palm. The only portion of the palm that is shown is the heel 42.

The channel 14 has an inner edge which is formed into an upturned arcuate flange 44. This flange 44 is quite thin in order to allow handle 16 to lie as close to the fingers 26, 28, 30 and 32 as is reasonably possible when the hand 20 is wrapped around the handle 16. The flange 44 is deflectable with this deflection being permitted mainly because it is thin as opposed to the main body of the hand accessory 10. The outer surface of the upturned arcuate flange 44 includes a plurality of finger engaging recesses 46 one of which is to connect with the little finger 32, another one to connect with the ring finger 30 and another one to connect with the middle finger 28 of the hand 20. It is to be noted that the amount of upturning of the flange 44 is sufficient to form a substantially right angle type configuration when observing of the flange 44 from the bottom of the hand accessory 10.

Also included within the front surface of the hand accessory 10 is a groove 48. This groove 48 is located between the channel 12 and the thumb 22. A portion of the groove 48 extends between the horizontal portion 52, and top surface 58 of the hand accessory 10 with this horizontal portion 52 to be located over the web portion 50 of the hand 20. The function of the groove 48 is to provide a thin, flexible wall around the sensitive thumb joint for comfort and to accommodate different thicknesses of hands and slightly different methods of grip. The back surface of this horizontal portion 52 forms an enlarged concave area 54 within which the web portion 50 is to be located. The horizontal portion 52 is located essentially at a right angle relative to the vertical section of the hand accessory 10. It is within the vertical section that the channel 12 is located.

For purposes of description within FIG. 1, the hand 20 is shown being located very near the butt 56 of the handle 16. In actual practice, the trailing hand 20 will be spaced a somewhat further distance from the butt 56 so as to permit the leading hand (not shown) to also engage with the handle 16 in between the trailing hand 20 and the butt 56.

The main propulsion area of the hand accessory 10 is the portion of the front surface that is directly adjacent the ridge 60 which separates groove 48 from channel 12. This main propulsion area produces rotation of the handle 16 away from the body of the user as the hand 20 pushes outward against the handle 16 during the swinging motion. The flange 44 adds strength to the fingers 28, 30 and 32 and pulling of the handle 16 toward the body of the user. A portion of the groove 48 is enlarged, forming concave area 62 which is to provide clearance for the tip of middle finger 28 during gripping and swinging of the handle 16. Also, the front surface is slightly concave at section 64 and will also provide clearance for the tip of the ring finger. The front surface of the hand accessory 10 located directly adjacent the concave area 64 is flat which permits pivoting of the handle 16 toward the body of the user at the end of the swing. This providing of the flat area 66 is necessary because inherently at the end of the swing the handle 16 will pivot toward the body of the user and the flat area 66 will permit this swinging. The angular relationship of the channel 12 is to direct the handle 16 towards the fingers of the hand 20 rather than toward the web portion 50. Keeping the bat handle 16 in the position of the fingers gives the user greater control and power. The inner edge section 68 is lowered as much as possible to not impede the movement of the handle 16 in a forward direction. The orienting of the longitudinal axis 14 toward the joint 40 of the index finger 26 in effect harnesses the power of the web portion 50 and the thumb base 24 to propel the bat handle 16 forward.

The back surface of the hand accessory 10 includes a ridge 70. This ridge 70 is designed to comfortably fit within the lifeline crease of the hand 20. Ridge 70 flattens somewhat near its upper area near 78, but is sharply right angled in the area of the midpoint of thumb base 24 in order to provide transfer of power through the strongest, most leveraged area of the thumb base 24. Rearwardly of the ridge 70 is a slightly concave area 72 which is designed to accommodate the bulbous muscle of the thumb base 24 and allow the greatest stress to be received by the just mentioned portion of thumb base 24 located at ridge 70. Forwardly of the ridge 70 there is a flattened section 74 which is at a right angle to area 72, for reasons of comfort to the hand 20 when the handle 16 is tightly gripped. It is to be noted that the finger recesses 46 ar substantially at a right angle 47 relative to the flattened area 74. It was found that the lower palm which we call the heel 42 is substantially different in two areas: midway up to the lateral crease is a tough, muscular area 41, and midway down to the lifeline crease is a boney, sensitive area 43. Thus, at the lowest portion of flattened area 74, there is a further flattening, or reduction of material, which is the area extending from ridge 70 to midway between ridge 70 and right angle 47, to prevent plug 10 from contacting sensitive area 43 during the middle portion of the swinging motion.

The back surface of the hand accessory 10 also includes a lateral ridge 76. This lateral ridge 76 is to fit partially within the web 50 and partially within the lateral crease of the hand 20 which establishes a "T" connection with the lifeline crease of the hand 20. The area 78 of the back surface of the hand accessory 10 is enlarged to fill the lower portion of the web portion 50 which is directly adjacent the upper portion of the palm 42.

Figure 7:
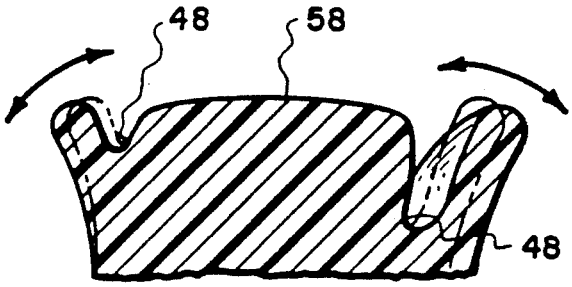
FIG. 7 is a cross-sectional view taken through line 7—7 of FIG. 4 depicting possible deflection of the hand accessory which is likely to occur when the hand accessory is tightly gripped onto the handle of the bat.
Figure 8:
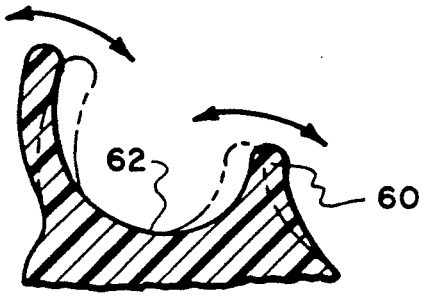
FIG. 8 is a cross-sectional view taken along 8—8 of FIG. 3 again showing a possible deflection of the hand accessory in phantom when the hand accessory is tightly gripped in conjunction with the handle of the bat.
Figure 9:
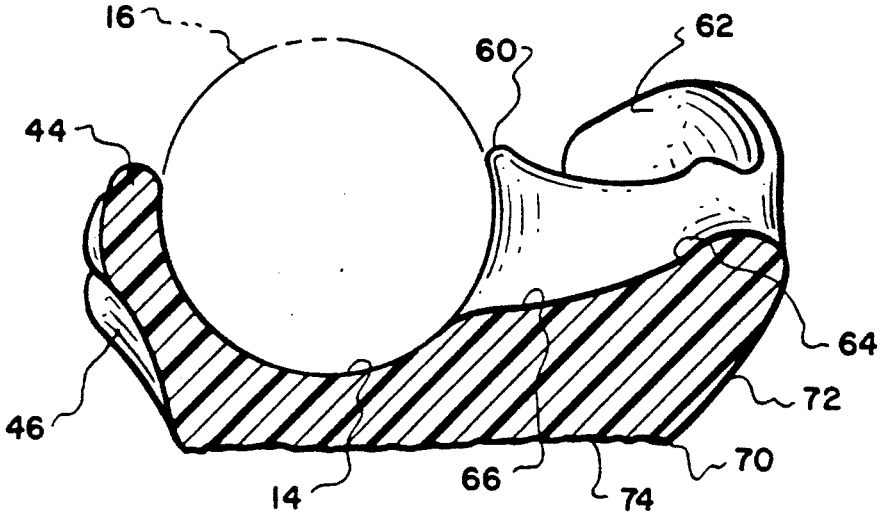
FIG. 9 is a cross-sectional view taken along line 9—9 of FIG. 3 showing the position of the baseball bat in phantom in conjunction with the hand accessory.

Referring particularly to FIGS. 7, 8 and 9, there are shown at rest positions for the hand accessory 10 in solid lines, and in phantom lines there is depicted the deflection that the hand accessory 10 is capable of when the hand 20 tightly grips the hand accessory 10 about the handle 16. This deflection not only accommodates different sizes of hands 20 but also increases the control and power being transmitted to the ball when the handle 16 of the bat is swung.

What is claimed is:

1. In combination with a handle of an implement where the handle is to be manually swung in motion by a hand of a human with the hand wrapped about said handle, the hand having a palm and a web portion located between the thumb and the fingers, the hand also having an index finger with a joint located between the index finger and the palm, a separate hand accessory to be positioned between said handle and the hand, said hand accessory comprising:

a plug having a front surface which is generally concave in configuration, said plug having a back surface which is generally convex in configuration, said front surface dimensioned to closely conform to said handle, said back surface comfortably pressing into the palm and the web portion of the hand, whereby said hand accessory functions to facilitate the transmission of a manual swinging force between the hand and said handle; and said front surface including a channel, said handle having a first longitudinal center axis, said channel having a second longitudinal center axis, said handle to be located within said channel with said first longitudinal center axis being located parallel to said second longitudinal center axis, said second longitudinal center axis being oriented to intersect the joint.

2. The combination as defined in claim 1 wherein:

the hand further includes a middle finger and a ring finger and a little finger, said plug having an inner edge to be located directly adjacent the middle finger and the ring finger and the little finger, said inner edge being formed into an upturned arcuate flange which is to partially wrap around said handle.

3. The combination as defined in claim 2 wherein:

said upturned arcuate flange assumes a generally right angled configuration relative to said front surface.

4. The combination as defined in claim 1 wherein:

said back surface includes a plurality of localized concave areas to provide clearance for comfort to the user's hand.

5. The combination as defined in claim 4 wherein:

said concave area is located to connect with the base of the thumb of the user.

6. The combination as defined in claim 4 wherein:

said concave area is located to connect with web portion of the hand.

7. The combination as defined in claim 1 wherein:

said back surface includes a plurality of ridges, each said ridge being adapted to connect with a crease formed within hand.

8. The combination as defined in claim 7 wherein: a portion of said back surface assume substantially a right angled configuration at said ridges.

9. The combination as defined in claim 8 wherein:

at least one of said plurality of ridges is flattened in the area furthest from the web portion, said flattened ridge providing comfort to the user.

10. In combination with a handle of an implement where the handle is to be manually swing in motion by a hand of a human with the hand wrapped about said handle, the hand having a palm and a web portion located between the thumb and the fingers, the hand also having an index finger with a joint located between the index finger and the palm, a separate hand accessory to be positioned between said handle and the hand, said hand accessory comprising:

a plug having a front surface which is generally concave in configuration, said plug having a back surface which is generally convex in configuration, said front surface dimensioned to closely conform to said handle, said back surface comfortably pressing into the palm and the web portion of the hand, whereby said hand accessory functions to facilitate the transmission of a manual swinging force between the hand and said handle;

said front surface including a channel, said handle having a first longitudinal center axis, said channel having a second longitudinal center axis, said handle to be located within said channel with said first longitudinal center axis being located parallel to said second longitudinal center axis, said second longitudinal center axis being oriented to intersect the joint; and said plug has an outer edge to be located directly adjacent the thumb, said front surface including a groove, said groove being located between the thumb and said channel, said groove causing the portion of said plug located directly adjacent the thumb to have flexibility to deflect when the hand is squeezed about said handle.

11. The combination as defined in claim 10 wherein:

said groove is of sufficient length to connect the portion of said plug that is mounted directly adjacent the web portion.

* * * * *